United States Patent [19]

Shakiba

[11] 4,118,173

[45] Oct. 3, 1978

[54] UNIDIRECTIONAL SEAL FOR FLOW PASSAGES

[75] Inventor: Hosein M. Shakiba, Philadelphia, Pa.

[73] Assignee: Samuel Lebidine, Glassboro, N.J. ; a part interest

[21] Appl. No.: 822,948

[22] Filed: Aug. 8, 1977

[51] Int. Cl.[2] ..... F23D 13/20

[52] U.S. Cl. ..... 431/202; 98/119; 126/307 A; 138/39; 138/44

[58] Field of Search ..... 126/307 A; 431/202; 98/119; 138/39, 44

[56] References Cited

U.S. PATENT DOCUMENTS

| | | | |
|---|---|---|---|
| 2,537,091 | 1/1951 | Rodman | 431/192 |
| 2,670,011 | 2/1954 | Bertin et al. | 60/39.77 |
| 3,662,669 | 5/1972 | Cullinane | 431/202 |
| 3,730,673 | 5/1973 | Straitz | 431/278 |

*Primary Examiner*—Carroll B. Dority, Jr.
*Attorney, Agent, or Firm*—Morton C. Jacobs

[57] ABSTRACT

A seal for flow passages has directional characteristics allowing gases or fluids to flow freely in one direction while restricting the flow in the opposite direction. The seal includes a flow diverter cone (or other inclined surface) which is spacedly mounted on a flow inverter cone (or other inclined surface) in a passage to effectively reverse the direction of undesired counterflow of gases without restricting normal gas flow. The seal has no moving parts but serves as an effective aerodynamic valve. Addition of this seal to the stack of a flare system, or to other chimneys, restricts the flow of air into the stack while allowing the waste gases to be exhausted with negligible restriction.

21 Claims, 10 Drawing Figures

UNIDIRECTIONAL SEAL FOR FLOW PASSAGES

BACKGROUND OF THE INVENTION

This invention relates to aerodynamic valves having directional flow characteristics and particularly to a unidirectional seal for flow passages. A particular application of this invention is to flare systems employing a flare stack containing a unidirectional seal to prevent counterflow of air into the system and the danger of resulting explosions.

It has long been recognized that the addition of specially designed seals to the flare stack of a waste gas burner system has some effect in preventing air from entering into the flare stack and producing uncontrolled combustible mixtures and the accompanying danger of explosion. In the case of chimneys, such a seal prevents air blowing down the stack under strong winds. These seals may reduce the quantity of purge gas required to keep air out of the system. The attempts at providing a similar device have had varying degrees of effectiveness. The use of a flapper valve and a flame arrester as a vent seal for a waste gas burner is described in U.S. Pat. No. 2,537,091. A unidirectional flow duct using frustroconical baffles is described in U.S. Pat. No. 2,670,011, and vent seals for a flare stack respectively using labyrinth and frustroconical baffles are described in U.S. Pat. Nos. 3,662,669 and 3,730,673.

SUMMARY OF THE INVENTION

It is among the objects of this invention to provide a new and improved aerodynamic valve having directional characteristics.

Another object is to provide a new and improved unidirectional seal for flow passages that is efficient.

Another object is to provide a new and improved flare stack having a seal that is effective in preventing air from entering the flare stack and that is economically fabricated and installed therein.

In accordance with an embodiment of this invention, a unidirectional seal for a fluid passage duct permits normal flow therethrough and substantially restricts counterflow through the duct. A diverter surface in the duct is spaced from the duct's inner surface and diverts counterflow of fluid towards the duct's inner surface to pass between the diverter and inner surfaces. An inverter surface spaced from the diverter surface and mounted in substantially sealed relation with the duct's inner surface inverts that counterflow passing between the diverter and inner surfaces and directs it to flow between the diverter and inverter surfaces and in the general direction of the normal flow. Thereby, the counterflow tends to be reversed in direction, and the reversed flow resists continuing counterflow, and an effective seal to that counterflow can be achieved.

In an embodiment of this invention, a flare system comprises a tubular flare stack for passing waste gases to a flare tip, which enables the gases to be burnt at its exhaust end, together with pilots and ignitors for ignition of flare gas. A unidirectional seal is located in the flare tip or between the flare tip and flare stack. This seal preferably includes a plurality of inclined surfaces mounted in the stack to permit normal flare gas flow through the stack and past the inclined surfaces. The apex of the included angle of inclined surfaces points to the direction of normal flow of the flare gas. An upstream inclined surface is in substantially sealed relation with an inner surface of the flare stack, and a downstream inclined surface is mounted in spaced relation to the inner flare stack surface and to the upstream inclined surface so as to direct counterflow of air between the downstream and inner surfaces and between the upstream and downstream inclined surfaces. Thereby counterflow of air through the flare stack is substantially restricted. In a specific form of this invention, a unidirectional seal for a flare stack is combined with a labyrinth baffle in an integrated structure.

BRIEF DESCRIPTION OF THE DRAWINGS

The foregoing and other objects of this invention, the various features thereof as well as the invention itself, may be more fully understood from the following detailed description when read together with the accompanying drawing, in which.

In the drawing, corresponding parts are referenced throughout by similar numerals.

DETAILED DESCRIPTION OF THE INVENTION

Figure 1:
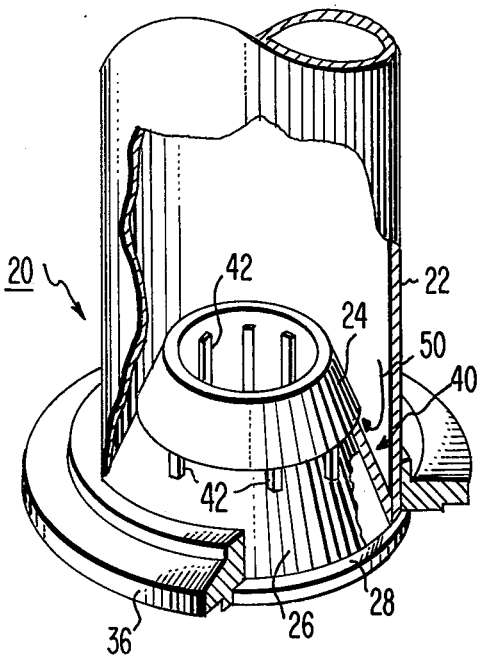
FIG. 1 is a perspective view of an aerodynamic valve embodying this invention, with parts broken away.
Figure 2:
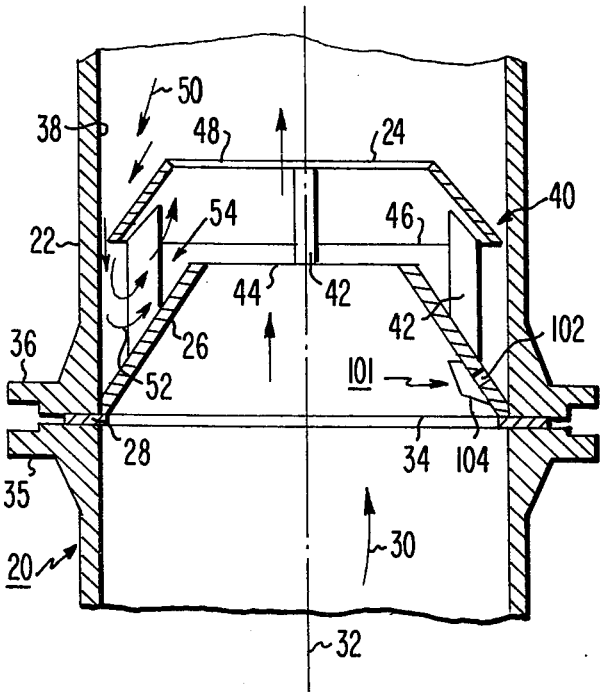
FIG. 2 is a vertical cross-sectional view of the aerodynamic valve of FIG. 1.

As shown in FIGS. 1 and 2, an aerodynamic valve 20 embodying one form of this invention is formed within a tubular duct 22 for passage of gas; the duct may have an orientation, e.g., vertical or horizontal, depending on the application. The valve 20 includes a diverter cone 24 suspended on and spaced from a base or inverter cone 26. The cones are tubular and preferably coaxial with the axis 32 of the passage duct 22.

The cones 24 and 26 converge generally towards the axis 32 of the duct 22 in the direction of normal flow 30 which enters the valve 20 at the base 34 of the inverter cone 26. The flange 28 of the inverter 26 at the base 34 provides a simple mode of attachment of inverter cone 26 into the duct 22; that is, the flange 28 is secured and sealed between mating flanges 35 and 36 at adjacent ends of upper and lower portions of the duct 22. The parts of the valve may be fabricated of various materials, e.g., sheet metals such as stainless steel or carbon steel are preferably used for flare system applications and plastics may be used for others.

The base 34 of inverter 26 is substantially sealed to the inner surface 38 of the duct 22. The diameter of cone base 34 may be substantially the same as the internal diameter of duct 22; or it may be substantially less, and an inwardly projecting extension of the flange 28 is used to maintain the sealed relation. The base of diverter cone 24 has a smaller diameter than that of the duct's inner surface 38 to provide a flow passage 40 between the diverter and inner surfaces 24 and 38, respectively. This diverter cone 24 is thus suspended within the duct 22, preferably by mounting it on struts 42 that extend between and are attached (e.g., by welding) to the upper surface of inverter 26 and the lower surface of diverter 24 (depending on the application, different numbers of such struts 42 may be used, for example, three to eight). The upper truncated opening 44 of inverter cone 26 has a smaller diameter than the base 46 of the diverter and preferably smaller than that of the diverter's upper truncated opening 48.

In operation, normal flow of gas along the arrow 30 is upward in the orientation of the duct shown in FIGS. 1 and 2. The inverter cone 26 provides very little restriction to that normal flow of gas. The inlet of the valve 20 for this normal flow 30 is the base 34 of the inverter, and the outlet is the truncated upper opening 48 of the diverter 24. Counterflow in the opposite direction, as shown by the arrow 50 (downward in the view of FIGS. 1 and 2), is diverted by the upper inclined surface of diverter cone 24 towards the inner surface of the duct 22 where it passes through the opening 40 between the diverter and that duct. This counterflow is blocked by the sealed base of the inverter and reversed in direction as shown by the flow arrow 52 through the passage 54 formed between the upper surface of inverter 26 and the under surface of diverter 24. This reversed counterflow 52 forms a viscous boundary or cushion for the normal flow 30 and also provides shearing resistance to the continuing downward counterflow 50. In effect, the counterflow 50 is a circulating current downward along the inner surface 38 of the duct 22 and upward through the central opening 48 where it reinforces the normal flow 30.

This aerodynamic reversal of the counterflow and the resulting unidirectional sealing action is extremely efficient. For example, it has been found that, with the source of a normal gas flow 30 disconnected from the input end of duct 22 and with the application of air under pressure at the output end blowing in the direction of counterflow arrow 50 through the duct 22, complete flow inversion of the blowing air is produced and a suction pressure is created at the input end of the duct 22.

Figure 3:
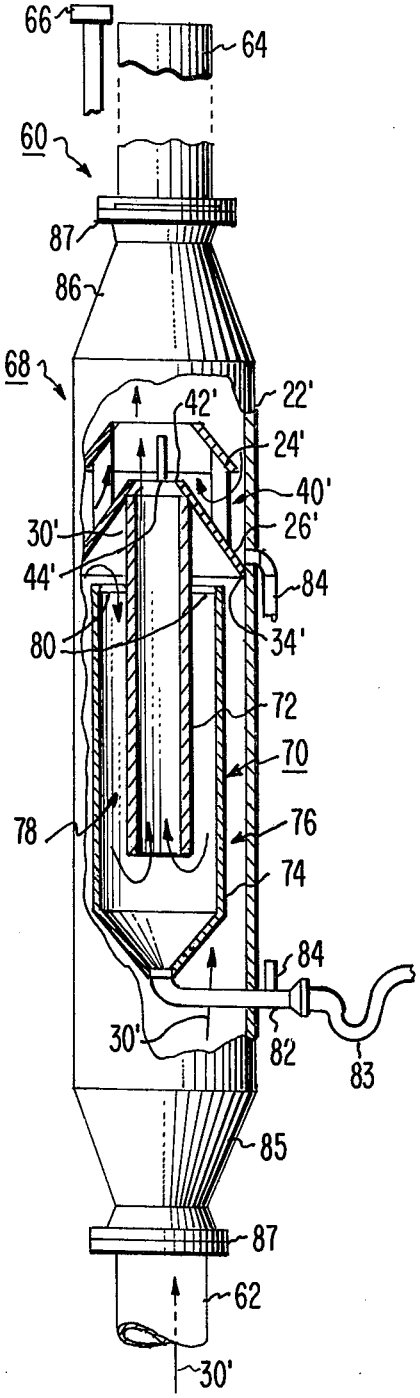
FIG. 3 is a side elevation view, with parts broken away and in section, of a portion of a flare system embodying this invention that includes a flare stack seal incorporating a modified form of aerodynamic valve.

This invention has a particular application as a unidirectional flare seal in a flare system 60, as shown in FIG. 3. The flare system includes a flue or stack 62 to which waste gases from an oil refinery or the like are supplied and which has a flare tip 64 (including an exhaust and burner end) at which those gases are burned under the control of a pilot and igniter system 66.

The unidirectional seal 68 of this invention may be fabricated as a unit to be inserted between the flare tip 64 and the flare stack 62 as shown in FIG. 3. In one alternative flare seal in such a flare system, the aerodynamic valve of FIG. 2 may be used alone to provide a flare seal, e.g., where the duct 22 is a flare stack or a free-standing chimney or flue tower; this flare seal is installed inside the flare tip or in between flare tip flange 36 and stack flange 35. In another alternative, the flare seal 68 of FIG. 3 includes the aerodynamic valve unit formed by diverter and inverter cones 24' and 26' (parts corresponding to those previously described are referenced by the same numerals in FIG. 3 with the addition of a prime (')) together with a labyrinth baffle 70 that is combined with the cones into an integrated structure. The inverter 26' is attached at its base to the inner surface 38' of the seal housing 22', preferably by welding therearound. At the upper opening 44' of inverter 26, a central baffle tube 72 is attached at its upper end, e.g., by welding. A baffle cup 74 is coaxially mounted between the baffle tube 72 and the inner surface 38' of the housing. Thereby, two labyrinth passages are formed; an outer annular one 76 through which the normal flow 30' of waste gases is upwards, and an inner annular one 78 through which the flow is downward, and whence the flow again reverses upwardly through the center exhaust tube 72 and through the center openings of the inverter 26' and diverter 24' up through the stack and into the burner 64.

At the upper end of cup 74, a plurality of radial struts 80 are attached (e.g., by welding between the cup's inner surface and outer surface of exhaust tube 70 so that the cup is suspended from that tube, which in turn is suspended from the inverter cone 26'. Thereby, an integrated seal structure is formed that requires but a single connection to housing 22' at the inverter cone base 34'. A drainage opening at the bottom of cup 72 connects through a cleanout pipe and flange 12 and a curved trap 83 for removal of liquids deposited in the flare. Drainage connections are also made to the sealed space above the lower welded base 34' of inverter cone 26' to remove deposited water via pipe 84 connecting with drain pipe 82. The aerodynamic valve of cones 24, 26', which is fabricated as an integrated unit, is secured to the duct's inner surface 38' at base 34' alone, e.g., by welding. The housing 22' is flared down at its lower and upper ends 85 and 86 are connected to the stack sections 62 and 64 by flanges 87 and 88. Where the chimney is a free standing tower, it is not flared down, but a weld connection is made.

In operation, the aerodynamic valve of inverter and diverter cones 26' and 24' functions as a flare tip seal in the manner described above. During normal operation, the waste gases flow from the stack 62 of the flare through the tip seal 24', 26' without significant restriction of flow. In case of an adverse flow of air down the flare, due to wind or a sudden reduction in the flare flow, the down flow air is deflected by the diverter cone 24' and turned around and back upwards by the inverter cone 26'. When the flare is not in operation and the down flow of air could cause an explosion in the lower part of the system, the tip seal, 24', 26' assisted by the fluid dynamic effect of purge gas, acts as a very effective means to keep the air out of the flare system.

Additional sealing action is achieved with labyrinth 70. The undersurface of the inverter cone 26' serves as part of the labyrinth baffle to direct normal flow of exhause gases passing up from the outer passage 76 into the inner passage 78, from which these gases are exhausted through tube 72. The pressure drops as the lighter-than-air flare gas flows through the labyrinth passages so that the pressure at the undersurface of cone 26' is normally greater than the pressure at the lower end of exhaust tube 70; the extent of this pressure inversion is a function of the dimensions of the passage between the two spaced points in the flow path. If there should be a sudden termination of the normal flow of exhaust gases, this inversion pressure head serves to block any tendency of air to flow downward from the top of the stack and enter the exhaust gas source, in a manner well known in the art. Thus the integrated structure of the aerodynamic valve and labyrinth baffle are cumulative in their effects of restricting counterflow of air down into the flare stack such as would produce combustible mixtures with the exhaust gas and the concomitant danger of explosions.

Figure 4:
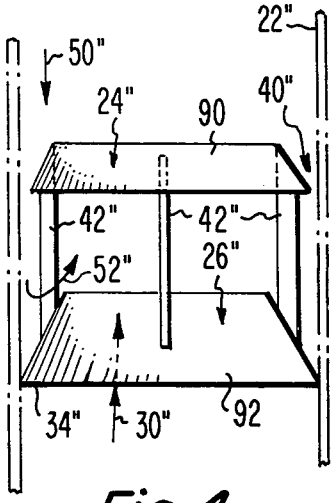
FIG. 4 is a side elevation view of a modification of the aerodynamic valve unit of FIG. 2 used in a rectangular passage duct.

This invention may also be used in rectangular ducts as illustrated in FIG. 4 (where parts corresponding to those previously described are referenced by the same numerals with the addition of a double prime (")). The diverter 24" and inverter 26" are formed as rectangular truncated pyramids, each face of which is a trapezoidal plate 90 and 92, respectively. The base of each pyramid 24" and 26" is generally similar to the cross-sectional shape (e.g., square, rectangular, or other polygonal shape) of the duct 22", the outline of which is shown in associated phantom lines. The diverter pyramid 24' is preferably secured by struts to the inverter pyramid 26' to form an integral unit therewith. The base 34" of the inverter pyramid is sealed at its periphery to the inner surface of duct 22' by welding or flanges in the manner described above.

In operation, the normal flow 30" is upward through the inverter pyramid and through the diverter pyramid 24". Counterflow 50" is deflected by the diverter 24" to flow through the passage 40" between the diverter and duct 22", and is reversed in direction by the inverter to form the upward flow 52' passing between the diverter and inverter, in a manner similar to that described above.

Figure 6:
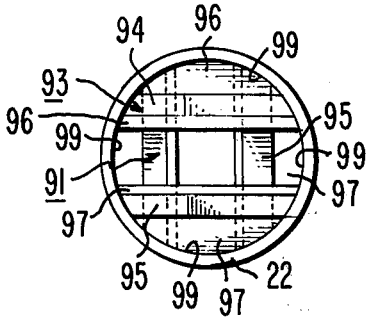
FIG. 6 is a horizontal cross-sectional view on the lines 6—6 of FIG. 5.
Figure 5:
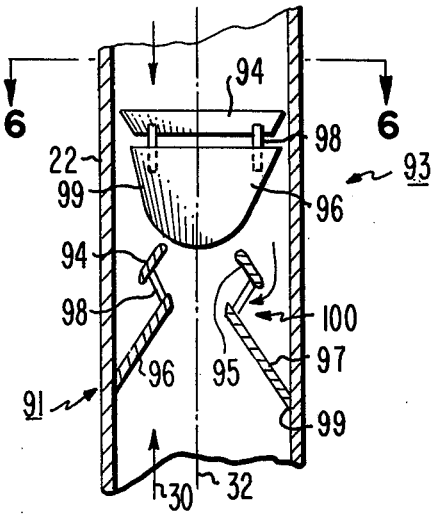
FIG. 5 is a vertical cross-sectional view of a modified form of this invention.
Figure 7:
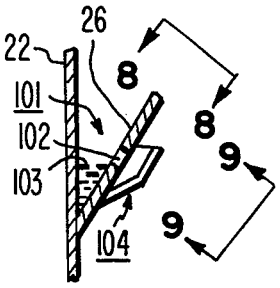
FIG. 7 is a detailed view of a fragment of the aerodynamic valve of FIG. 2 illustrating a drainage passage.

In the embodiment of FIGS. 5 and 6, the inverter and diverter sections are formed in two parts 91 and 93 that are located in different levels one above the other. In the lower part 91, a pair of diverter and inverter plates 94 and 96, respectively, are connected as a unit via struts 98. A second pair of diverter and inverter plates 95 and 97, respectively, are similarly constructed and mounted in opposing relation so that the inclined surfaces of those plates converge towards the axis 32 of the duct 22 in the direction of normal flow 30. The diverter plates 94 and 95 are generally flat trapezoidal shaped members, and the inverter plates 96 and 97 have a flat upper edge and an elliptical lower edge 99 along which they are welded to the circular tube forming the duct 22 (if the duct is rectangular, the inverter plates 96 and 97 are made with straight lower edges and are generally formed as trapezoids for the welding seal). The upper section 93 has two opposing pairs of diverter and inverter plates 94, 96 and 95, 97 that are similarly fabricated except that they are oriented at right angles to those of section 91. Thus the two pairs of diverter and inverter plates 94, 96 and 95, 97 forming the upper section 93 capture the counterflow 50 of gas flowing down two opposing quadrants of the duct 22 and the other two pairs of plates 94, 96 and 95, 97 of the lower section 91 to capture the other two corresponding quadrants of counterflow down the duct 22.

Figure 8:
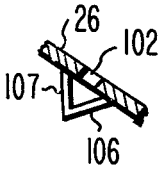
FIG. 8 is a cross-sectional view taken on the line 8—8 of FIG. 6.
Figure 9:
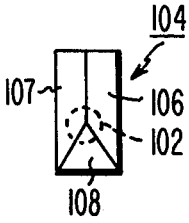
FIG. 9 is a side view as seen from the line 9—9 of FIG. 6.

These diverter and inverter plates operate in a manner similar to that described above, with the diverter plate 94 diverting counterflow 50 in its quadrant towards and along the inner surface of the duct 22, and the sealed edge 99 of inverter plate 96 receiving that counterflow and reversing it upwardly to be directed through the passage 100 between the two plates 94 and 96. Each pair of plates operates in the same fashion on the counterflow in its own quadrant. This construction of FIGS. 5 and 6 offers the advantage of fabricating the inverter and diverter as flat plates similar to those used in the pyramidal structure of FIG. 4. In that latter structure too, the flat plates 90 and 92 (instead of being assembled in pyramids) can be formed as individual pairs of diverter and inverter plates with opposing pairs located at different levels of the duct 22". However, generally there is no advantage in the embodiment of FIG. 4 in locating these pairs of plates at different levels within the duct, while the use of flat plates for the valve of a circular duct 22 is thereby made possible. One or more water drains 101 may be formed in the surface of the inverter 26, as shown in FIG. 2 and FIGS. 7–9. This drain consists of an orifice 102 cut through the wall of the inverter cone 26, with a gas flow deflector 104 welded about that opening on the inner surface of the inverter cone 26. This deflector as shown in FIG. 8 is formed of three flat sections 106, 107, 108 which form a suitable surrounding shield for the small opening 102. The deflector 104 is effective for deflecting upwards any small quantity of air that passes through the orifice 102, so that such orifice-limited counterflow is correspondingly inverted upward. In addition, any small accumulation of water 103 would tend to block that opening 102 from gas flow, while large water accumulations are prevented due to drainage through orifice 102. Thus, water drainage is achieved, while effectively reversing the direction of the counterflow and effectively isolating the counterflow to above the inverter cone 26'.

Figure 10:
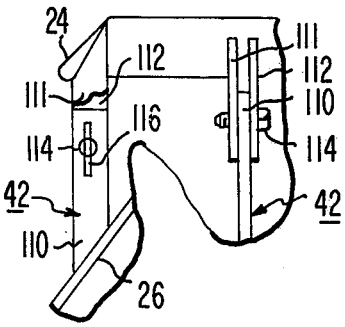
FIG. 10 is a detailed view of a modification of the aerodynamic valve of FIG. 2.

As shown in FIG. 10, the struts 42 may be formed as adjustable sections, so that the passage 54 formed between the diverter and inverter surfaces (e.g., cones) 24 and 26 may be adjusted in size as required in particular installations. That is, in one form of such adjustment, each strut is formed with a leg 110 connected to the inverter 26, and a pair of legs 111 and 112 connected to the undersurface of the diverter 24. Mating slots 116 formed in the overlapping portions of these three legs 110, 111, 112 enables their relative adjustment. The lower leg 110 slides between the upper legs 111 and 112 and all three legs are held coupled together in adjusted position by a suitable fastening bolt 114. Thereby, the desired elevation of the diverter 24 above the inverter 26 and the desired dimensions of counterflow passageway 54 therebetween can be changed and adjusted. Moreover, the entire diverter 24 can be readily removed and replaced by one of different dimensions (e.g., angle of inclination or upper or lower diameters) to accommodate changes in overall operating characteristics.

The angles of inclination of the diverter and inverter surfaces and the dimensions of their flow openings varies with the application and installation. For example, the inclination of the inverter surface to the duct axis 32 (e.g., ranging from 25°–35°) is generally greater than that of the diverter surface (e.g., 20°–30°). The inverter cone preferably has a venturi characteristic for normal gas flow with concomitant velocity increase, and its dimensions are selected accordingly. Generally, the diameter of the diverter's truncated opening 48 is larger than that 44 of the inverter, and may be chosen to follow the contour of an imaginary venturi section that is increasing in diameter. The diameter of diverter base 46 is generally less than that of inverter base 34, so that the inverter surface is generally larger than that of the diverter. However, these dimensions may be varied to meet particular installation requirements; for example, an inverter cone with a 48-inch base may be used with a stack of 54-inch diameter by connecting an annular flat sealing plate therebetween; and the diameter of the diverter base may be designed independently to control the counterflow appropriately. Because the counterflow 50, 52 rolls around the diverter 24, a cross-section similar to an airfoil may desirably be used in some applications, and generally its edge at the upper opening 48 should preferably be tapered inwardly. Inclined curved surfaces for the diverter and inverter may give better diversion and inversion control of the counterflow; however, such curvature along the directions of flow are generally much more expensive to fabricate (especially in metals) than the straight surfaces described above for the illustrative embodiments.

Other forms of labyrinth baffles may be used; for example, another suitable baffle is an inverted configuration of cup and central tube, where the latter is the inlet passage. By combining the aerodynamic seal and labyrinth baffle in one structure, the flow control and sealing effects are additively effective; that is, the pressure inversion opposing counterflow of air that is produced upon termination of normal flare gas flow is cumulative with the pressure resistance to counterflow produced by the inclined surfaces of the aerodynamic seal. The housing and other flow surfaces also serve various functions in common.

Accordingly, a new and improved aerodynamic valve is provided with directional flow characteristics and which serves as a unidirectional seal for flow passages. A flare system incorporating this unidirectional seal is simpler to assemble with but a single connection required (e.g., weld or flange) between seal and flare tip. The flare seal can be easily adjusted or disassembled and modified to meet changed operating conditions. Water build-up in the seal is prevented without impairing its isolating characteristics. The flare seal is inexpensive to construct from sheet metal, easy to install and maintain, and adaptable to a wide variety of shapes and sizes of the ducts used in flares and chimneys. The aerodynamic seal can also be constructed in an integral unit with a labyrinth baffle for cumulative sealing effectiveness.

It will be apparent to those skilled in the art from the foregoing illustrative embodiments that this invention is not limited to the specific embodying details, but is of a scope set forth in the following claims.

What is claimed is:

1. A flare system for exhaust gases comprising:

a tubular exhaust passage including a flare stack and tip having a burner at its exhaust end and a pilot for ignition of flare gas at said burner;

and a unidirectional seal in said exhaust passage including a plurality of inclined surfaces mounted in said passage to permit normal flare gas flow through said passage and past said inclined surfaces, and positioned to incline towards the axis of said passage in the direction of said normal flare gas flow, upstream and downstream ones of said inclined surfaces being mounted adjacent each other, said upstream inclined surface being in substantially sealed relation with an inner surface of said exhaust passage, said downstream inclined surface being mounted in spaced relation to said inner passage surface and to said upstream inclined surface so as to direct counterflow of air between said downstream and inner surfaces and between said upstream and downstream inclined surfaces, whereby counterflow of air through said flare stack is restricted.

2. A flare system as recited in claim 1 wherein said inclined surfaces are truncated conical surfaces.

3. A flare system as recited in claim 2 wherein said conical surfaces are substantially coaxial with the axis of said exhaust passage to pass normal flare gas flow therealong.

4. A flare system as recited in claim 1 wherein said inclined surfaces are generally flat.

5. A flare system as recited in claim 4 wherein said exhaust passage has a rectangular cross-section and said inclined surfaces form the faces of truncated pyramids.

6. A flare system as recited in claim 4 wherein said inclined surfaces are formed as pluralities of opposing pairs of upstream and downstream inclined plates, one plurality of said opposing pairs of inclined plates being located at one axial position of said passage, and another plurality of said opposing plate pairs being located at an adjacent axial position.

7. A flare system as recited in claim 3 wherein said upstream and downstream conical surfaces are assembled as a unit and attached to said exhaust passage at a single connection.

8. A flare system as recited in claim 7 wherein said single connection includes connecting flanges at adjacent ends of said flare stack and flare tip, and a flange at the base edge of said upstream conical surface assembled between said connecting flanges.

9. A flare system as recited in claim 7 wherein said single connection includes a bonding joint between the base edge of said upstream conical surface and the inner surface of said exhaust passage.

10. A flare system as recited in claim 2 wherein said unidirectional seal further includes a labyrinth baffle on the upstream side of said upstream conical surface.

11. A flare system as recited in claim 10 wherein said labyrinth baffle includes an inner exhaust tube connected to the opening at the truncated edge of said upstream conical surface.

12. A flare system as recited in claim 11 wherein said exhaust tube is supported by said upstream conical surface.

13. A flare system as recited in claim 12 wherein said labyrinth baffle further includes a cup between said exhaust tube and the inner surface of said exhaust passage to form annular passageways therewith including one having a pressure inversion therein upon termination of normal flare gas flow.

14. A flare system as recited in claim 2 wherein said downstream conical surface is connected to and supported by said upstream conical surface.

15. A flare system as recited in claim 1 wherein said unidirectional seal includes means for adjustably mounting said downstream inclined surface to vary the axial spacing being said downstream and upstream surfaces.

16. A flare system as recited in claim 15 wherein said adjustable mounting means includes strut means of variable length connecting said downstream surface to said upstream surface.

17. A flare system as recited in claim 1 wherein said upstream inclined surface includes a water draining orifice therethrough and adjacent the portion thereof in said sealed relation, and inclined deflector means covering said orifice on the upstream side of said upstream inclined surface for reversing the direction of air counterflow passing through said orifice.

18. In a flare system for exhaust gases having a tubular exhaust passage including a flare stack and tip having a burner at its exhaust end and a pilot for ignition of flare gas at said burner; a unidirectional seal to restrict counterflow of air through said flare stack, said unidirectional seal comprising:

a tubular housing forming part of said exhaust passage, at least one inclined surface mounted in said housing and having portions surrounding the axis of said housing to permit normal flare gas flow through said housing and past said inclined surface, and positioned to incline towards the axis of said passage in the direction of said normal flare gas flow, an outer edge of said inclined surface being in substantially sealed relation with an inner surface of said housing and a labyrinth baffle mounted in said housing upstream from and adjacent to said sealed inclined surface to receive said flare gas at an inlet end and pass said flare gas from an exhaust end to said inclined surface, said baffle having a plurality of passageways including one forming a pressure inversion opposing counterflow of air upon termination of normal flare gas flow, said inclined surface being a truncated conical surface, and said baffle including an exhaust tube connected to the truncated edge of said conical surface.

19. A unidirectional seal for permitting normal gas flow, through a fluid passage duct and for substantially restricting counterflow of gas through said passage duct, said seal comprising:

means including a surface in said passage duct and spaced from the inner surface of said passage duct for diverting counterflow of gas towards said inner duct surface to pass between said diverting and inner surfaces, said diverter surface means including an inner opening for passing normal gas flow, and means including another surface spaced from said diverting surface and in substantially sealed relation with said duct inner surface for inverting said counterflow of gas passing between said diverting and inner surfaces to flow between said diverting and inverting surfaces and through said diverter inner opening in the general direction of said normal flow, said inverter surface means including an inner opening aligned with said diverter inner opening for passing normal gas flow.

20. A unidirectional seal as recited in claim 19 wherein said diverter and inverter surfaces include surface portions extending substantially about the inner periphery of said passage duct.

21. A flare system as recited in claim 1 wherein said unidirectional seal further includes a labyrinth baffle mounted in said housing upstream from and adjacent to said sealed inclined surface to receive said flare gas at an inlet end and pass said flare gas from an exhaust end to said inclined surface, said baffle having a plurality of passageways including one forming a pressure inversion opposing counterflow of air upon termination of normal flare gas flow.

* * * * *